United States Patent [19]

Lake

[11] Patent Number: 4,788,728

[45] Date of Patent: Dec. 6, 1988

[54] CONTOURED PILLOW WITH CENTRAL APERTURE

[76] Inventor: Kerry L. Lake, 511 Fifth Ave., W., Kirkland, Wash. 98033

[21] Appl. No.: 54,876

[22] Filed: May 26, 1987

Related U.S. Application Data

[63] Continuation-in-part of Ser. No. 892,847, Aug. 4, 1986, abandoned.

[51] Int. Cl.[4] ..... A47C 20/02

[52] U.S. Cl. ..... 5/434; 5/436; 5/490

[58] Field of Search ..... 5/434–442, 5/490

[56] References Cited

U.S. PATENT DOCUMENTS

| | | | |
|---|---|---|---|
| 1,020,444 | 3/1912 | Platt . | |
| 1,242,598 | 10/1917 | Riddle | 71/428 |
| 1,542,674 | 6/1925 | Darling . | |
| 2,167,622 | 8/1939 | Bentivoglio . | |
| 2,551,727 | 5/1951 | Costello . | |
| 2,556,629 | 6/1951 | O'Brien . | |
| 2,561,931 | 7/1951 | Kleiser, Jr. . | |
| 2,688,142 | 9/1954 | Jensen . | |
| 2,765,480 | 10/1956 | Mueller . | |
| 2,810,920 | 10/1957 | Carruth . | |
| 2,940,088 | 6/1960 | Boos | 5/436 |
| 2,952,856 | 9/1960 | Ruff . | |
| 3,276,046 | 10/1966 | Capelli . | |
| 3,400,413 | 9/1968 | La Grossa . | |
| 3,602,928 | 9/1971 | Helzer . | |
| 3,829,917 | 8/1974 | De Laittre et al. | 5/434 |
| 3,848,281 | 11/1974 | Mathews . | |
| 3,900,910 | 8/1975 | Nakata . | |

FOREIGN PATENT DOCUMENTS 101524 11/1981 Fed. Rep. of Germany .

*Primary Examiner*—Michael F. Trettel
*Attorney, Agent, or Firm*—Joan H. Pauly

[57] ABSTRACT

A generally rectangular pillow (2, 2', 2'') has a rounded forward neck support portion (10, 10''), a rear head support portion (12, 12', 12''), side portions (24), and a bottom portion (26, 26''). An oblong hollow (30) is formed in the top surface (6) of the pillow body (2, 2', 2''). The hollow (30) accommodates the lower portion of the face of a user lying in a side position to prevent pressure on the face. A projection (42, 42'') extends forwardly from rear portion (12, 12', 12'') into hollow (30). In use, the rear portion (12, 12', 12'') has a central depression for the top of the user's head. The depression is formed by contouring the top surface of the rear portion (12, 12') or by reducing the density at the center of the rear portion (12''), such as by forming an internal cavity (44). A pillowcase (50) has central edges (56, 58) that are fastened to bottom portion (26) to leave hollow (30) unobstructed. Another pillowcase (80) has two top pieces (82, 84) with curved laterally extending edges (86) that are sewn together and cause the top of the pillowcase (80) to drape down into the hollow (30).

31 Claims, 6 Drawing Sheets

Fig. 4
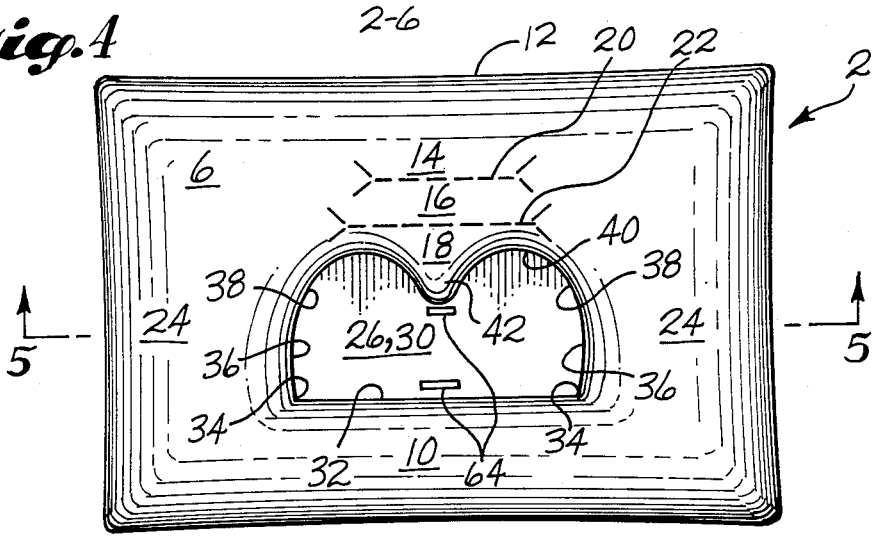
Fig. 5
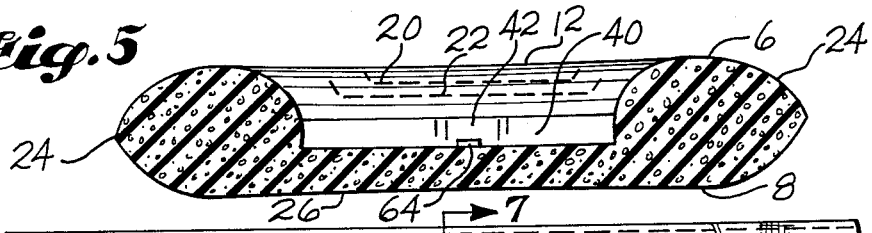
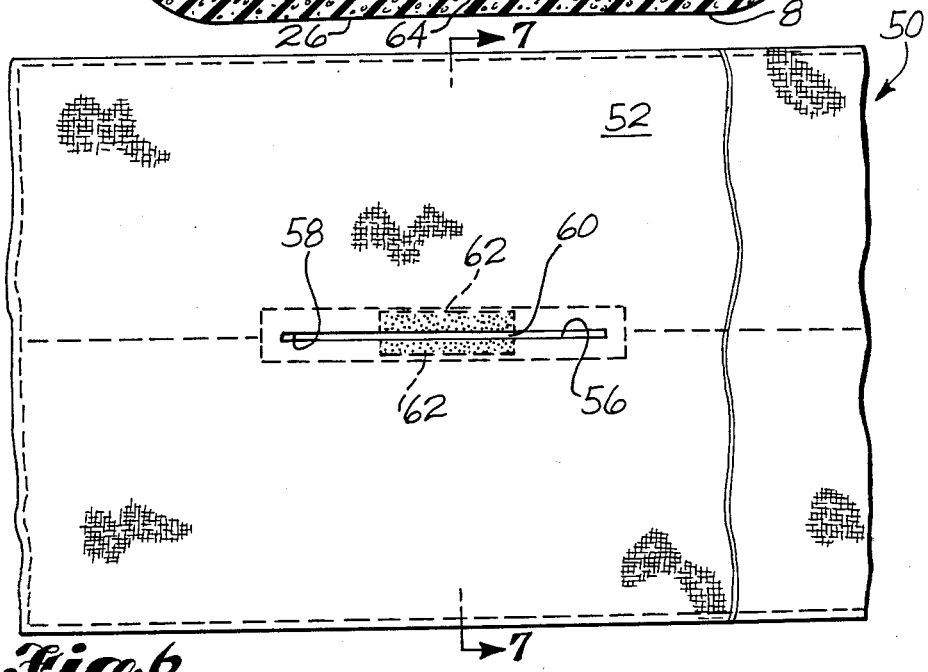
Fig. 6
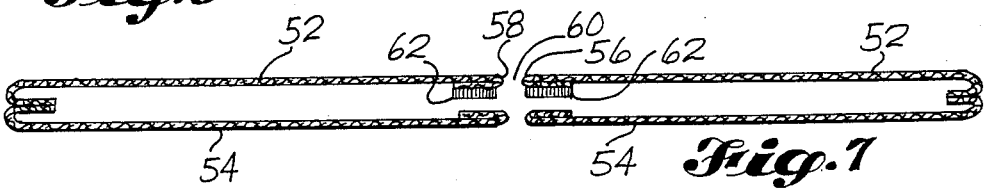
Fig. 7

CONTOURED PILLOW WITH CENTRAL APERTURE

This is a continuation-in-part of Ser. No. 892,847, filed Aug. 4, 1986, now abandoned.

TECHNICAL FIELD

This invention relates to pillows and pillowcases and, more particularly, to a pillow that has a forward neck support, a rear upper head support which guides the head toward the center of the pillow, and a hollow between the head and neck supports shaped to accommodate different head sizes and to prevent pressure on the user's face, and a pillowcase that leaves the hollow unobstructed.

BACKGROUND ART

The standard rectangular solid-bodied pillow has been in common use for many years in spite of a number of serious drawbacks. Standard pillows exert a good deal of pressure on a user's face when the user is lying in a side position, which is a favorite sleeping position for many people. This pressure is generally uneven and can result in creasing of the face, especially in areas of relatively high pressure. As the user grows older, these creases become increasingly persistent and may not completely fade until several hours after the user has awakened. Moreover, over a period of time the daily pressure on the face for a period of several hours may encourage the formation of permanent facial wrinkles and thus accelerate the aging of the face. In addition to having undesirable effects on the face of a user, conventional pillows do not properly support the neck and head of a user and, therefore, can lead to relative discomfort during sleep or rest and neck pains or backaches following sleep or rest periods. Still another drawback of conventional pillows is that they can cause earaches because they exert pressure on the ear of a user lying in a side position.

Headrests having openings to allow breathing in a prone position are disclosed in U.S. Pat. No. 1,242,598, granted Oct. 9, 1917, to J. W. Riddle; No. 1,542,674, granted June 16, 1925, to A. O. Darling; No. 2,551,727, granted May 8, 1951, to A. C. Costello; No. 2,556,629, granted June 12, 1951, to C. M. O'Brien; No. 2,688,142, granted Sept. 7, 1954, to E. V. Jensen; and No. 2,810,920, granted Oct. 29, 1957, to W. T. Carruth. The Jensen headrest has bar-like side members that engage the face, a forward chin support, and a forwardly sloping forehead support. U.S. Pat. No. 1,020,444, granted Mar. 19, 1912, to S. L. Platt, discloses a pillow having rolls of firmer material incorported along its longitudinal edges to prevent the head from thrusting forward when the user is in a supine position. U.S. Pat. Nos. 2,765,480, granted Oct. 9, 1956, to E. S. Mueller, and 2,952,856, granted Sept. 20, 1960, to C. B. Ruff, each disclose a pillow having two side pads connected by a flat web.

U.S. Pat. No. 3,602,928, granted Sept. 7, 1971, to F. V. Helzer, discloses an inflatable pillow having a forward portion for supporting the neck, shoulders, and lower head of the user, a central aperture for protecting the hairdo of the user, and a surge chamber rearward of the aperture. The aperture is elongated, and the pillow is described as being suitable for use in a supine prone, or side position. Helzer also discloses a cover for the forward support portion of the pillow. The cover is a flat cloth with four triangular corner pockets that engage the forward corners of the pillow when the cover is wrapped around the forward portion.

U.S. Pat. No. 3,400,413, granted Sept. 10, 1968, to E. La Grossa, discloses a contoured pillow having a central contoured depression for accommodating hair curlers. The depression has outwardly and upwardly curved side and end walls that are described as permitting the user's head to turn in any way during sleep.

Various uses for apertured pillows are discussed in U.S. Pat. No. 3,848,281, granted Nov. 19, 1974, to D. I. Mathews. The uses discussed include supporting the head of a sleeping or reclining infant to avoid undesirable effects on the formation of the ears and head when the infant favors sleeping on one side of the head. Mathews discloses a cover for apertured pillows having a toroidal or other shape. The cover does not have any fasteners that might be swallowed by an infant. The cover includes two attached "enclosures" that fit around the pillow and double over each other to leave the aperture open.

U.S. Pat. No. 2,167,622, granted Aug. 1, 1939, to M. Bentivoglio, discloses a pillow having two opposite side wings and a miniature forward bolster for supporting the neck. The side wings are separated by a generally flat, forwardly inclined portion and engage the sides of the head. The rear space between the side wings is described as allowing ventilation of the head and sufficient clearance for a hairdo rearwardly of the pillow to avoid disturbing the hair.

U.S. Pat. No. 2,561,931, granted July 24, 1951, to E. H. Kleiser, Jr., discloses a generally horseshoe-shaped inflatable pillow. The pillow has a body shaped like two-thirds of a toroid with a rounded cross section having an inner perimeter of reduced thickness.

German Utility Pat. No. 101,524.0, in the name of H. Gienanth, opened to public inspection Nov. 5, 1981, discloses an orthopedic pillow. The pillow has a central aperture and opposite, apparently alternative, neck supports. The edge of the aperture adjacent one of the neck supports is straight and meets the sides of the aperture at substantially right angles. The edge of the aperture adjacent the other neck support has a curved, generally circular configuration.

Pillows with central depressions are disclosed in U.S. Pat. Nos. 3,276,046, granted Oct. 4, 1966, to G. L. Capelli; 3,829,917, granted Aug. 20, 1974, to E. W. De Laittre, deceased et al.; and 3,900,910, granted Aug. 26, 1975, to Y. Nakata. In the Capelli pillow, the sidewalls of the body of the pillow forming a central cavity are described as providing support for the temple, cheek, chin, neck, and back of the head and as providing the desired facial support. The De Laittre et al. pillow has a central trough on which the user rests his head and the bottom wall of which is illustrated as exerting supporting forces on the side of the head. Nakata discloses a water pillow having a top wall with a concavity and a bottom wall with concave grooves that maintain the water balance within the pillow and prevent water from being displaced from the area of the top concavity when a user rests his head on the concavity.

The above patents and the prior art that is discussed and/or cited therein should be studied for the purpose of putting the present invention into proper perspective relative to the prior art.

DISCLOSURE OF THE INVENTION

The invention is directed toward providing an improved pillow. According to an aspect of the invention, the pillow comprises a generally rectangular body having a top surface, a bottom surface, an oblong hollow formed in the body and opening onto the top surface, a forward portion and a rear portion. The rear portion has a laterally central portion that forms a laterally central depression in the rear portion when the pillow is in use, to provide a resting place for the top of a user's head at the lateral center of the pillow and to encourage the user to maintain the head near said lateral center. The hollow, forward portion, and rear portion are dimensioned and positioned so that, when a user is lying in a supine position, a top portion of the back of the user's head is supported by the rear portion, the back of the user's head below the top portion is adjacent to the hollow, and the user's neck is supported by the forward portion, and when the user turns from a supine position to a side position, the user's neck and a top portion of the user's head continue to be supported by the forward portion and the rear portion, respectively, and a lower portion of the user's face below the user's temple moves into a position adjacent to the hollow to prevent the pillow from exerting pressure on this lower portion of the face. Preferably, the forward portion has a first maximum thickness, and the rear portion has a second maximum thickness that is no greater than the first maximum thickness.

The structure of the body of the pillow has a number of advantages. The provision of the hollow and its dimensioning and positioning to be adjacent to the user's face solve the problems discussed above of creasing of the face and earaches and, in addition, prevent face creams and other preparations from rubbing off the face during sleep. The hollow and its dimensioning and positioning also prevent the pillow from exerting pressure on the face that might accelerate permanent wrinkling of the face. The positioning of the forward neck support portion and the rear upper head support portion and their preferred relative thicknesses ensure proper and comfortable support and relative positioning of the head and neck during sleep or rest to help prevent or alleviate neck aches and backaches. The central depression formed by the rear portion of the body provides a properly positioned support surface for the top portion of the head and an ideal resting place for the top of the head at the lateral center of the pillow to encourage the user to maintain the head in its proper position near the center of the pillow when the user rolls over.

According to another aspect of the invention, the pillow comprises a generally rectangular body having a top surface, a bottom surface, an oblong hollow formed in the body and opening onto the top surface, a forward portion, and a rear portion. The hollow has a forward edge, and a rear edge with a center portion that projects forwardly toward the forward edge. The hollow, forward portion, and rear portion are shaped and positioned so that the user's head and neck will be supported in a supine or side position as described above. The forward projection formed on the rear edge of the hollow has the advantages of providing additional support for the top of the head to increase the comfort of a user, helping to accommodate differences in head sizes of users, and increasing the dimensional stability of the pillow.

The hollow in the pillow may take various forms. Preferably, the hollow has an essentially straight forward edge, opposite side edges that meet the straight forward edge at substantially square forward corners, and arcuate edge portions connecting the side edges to a rear edge. The arcuate edge portions of this preferred configuration help to stabilize the shape of the hollow and, in embodiments in which the rear portion forms a central depression, cooperate with the depression to encourage the head of the user to maintain a center position on the pillow.

The forming of the central depression may be accomplished by contouring the top surface of the rear portion. This contouring may take various forms. In a first preferred embodiment of the pillow, the central depression is formed by a plurality of laterally extending rounded ridges separated by a plurality of laterally extending valleys. Each valley has a length that is less than the length of any such valley positioned forward thereof. The rear portion decreases in thickness in a forward direction from ridge to ridge and from valley to valley. In a second preferred embodiment, the central depression is formed by a plurality of valleys separated by a plurality of rounded ridges. The valleys include a forwardly extending center valley and opposite side valleys that extend rearwardly and laterally inwardly. In both of these embodiments, the contouring of the rear portion top surface adds stability to the shape of the body of the pillow.

The forming of the central depression may also be accomplished in other ways. One such other way is to reduce the density of the central portion of the rear portion relative to surrounding parts of the rear portion to form the central depression when pressure is applied to the rear portion. In a third preferred embodiment, the density is reduced by providing a laterally central internal cavity in the rear portion. A preferred feature which may also be incorporated is the forming of the forward portion with a laterally central internal cavity to reduce the density of the forward portion at its lateral center and form a forward laterally central depression when pressure is applied to the forward portion to encourage a user to maintain the neck near the lateral center of the forward portion. This feature cooperates with the depression in the rear portion to further reinforce the user's tendency to maintain the head in its proper position near the center of the pillow.

A preferred feature of the invention is a pillow body having side portions that are dimensioned to give the pillow an overall standard size and that have sufficient firmness to stabilize the shape of the body. In pillows having this preferred feature, the standard overall dimensions of the pillow body prevent the pillow from detracting from the appearance of a made bed. Another preferred feature of the invention is a forward portion of the body which has a rounded cross section to help maximize the comfort of the user. Still another preferred feature is a bottom portion of the body that extends between the forward and rear portions and defines a bottom of the hollow, to increase the dimensional stability of the hollow and the forward and rear portions.

The pillow described above may be provided in combination with a pillowcase. According to an aspect of the invention, the pillowcase comprises a top layer and a bottom layer dimensioned to receive the body of the pillow therebetween. The top layer has a laterally extending opening defined by a rear edge and a forward edge. The opening is aligned with the hollow in the pillow. Fastening means is carried by the rear edge and the forward edge of the top layer of the pillowcase and by the bottom portion of the pillow body. Such means fastens the rear edge and the forward edge to the bottom portion, to cover the rear portion and the forward portion of the pillow while leaving the hollow substantially unobstructed to prevent the pillowcase from exerting pressure on the lower portion of the user's face. This combination has the advantages of providing a removable cover for proper hygiene while maintaining the benefits of the uncovered pillow. In addition, the cover may be provided in various colors or designs to match or complement the surrounding decor and/or other bedding materials.

According to another aspect of the invention, the pillowcase comprises a top layer and a bottom layer dimensioned to receive the body of the pillow therebetween, and an opening for receiving the pillow. The top layer is formed from two pieces each of which has a laterally extending inner edge aligned with the hollow. The inner edges of the two pieces are joined together and are curved outwardly to cause the top layer to drape down into the hollow to leave the hollow substantially unobstructed and prevent the pillowcase from exerting pressure on the lower portion of the user's face. The combination of the pillow and this pillowcase has the advantages discussed above in connection with another embodiment of the pillowcase and the additional advantages of being very simple in construction, not requiring any fasteners, and resulting in a pleasing, gracefully draped appearance of the pillow and pillowcase.

Pillows constructed according to the invention have a unique combination of advantages. Each of these advantages is maximized without sacrificing any of the other advantages. Pillows made in accordance with the invention provide proper and comfortable support for the head and neck and protect the face and ears of the user while maintaining the user's freedom of movement. Pillows of the invention are also attractive and are readily incorporated into a standard bedding arrangement.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 4 is a top plan view of the pillow shown in FIGS. 1–3.

FIG. 5 is a sectional view taken along the line 5—5 in FIG. 4.

FIG. 6 is a top plan view of a first preferred embodiment of the pillowcase.

FIG. 7 is a sectional view taken along the line 7—7 in FIG. 6.

BEST MODES FOR CARRYING OUT THE INVENTION

Figure 1:
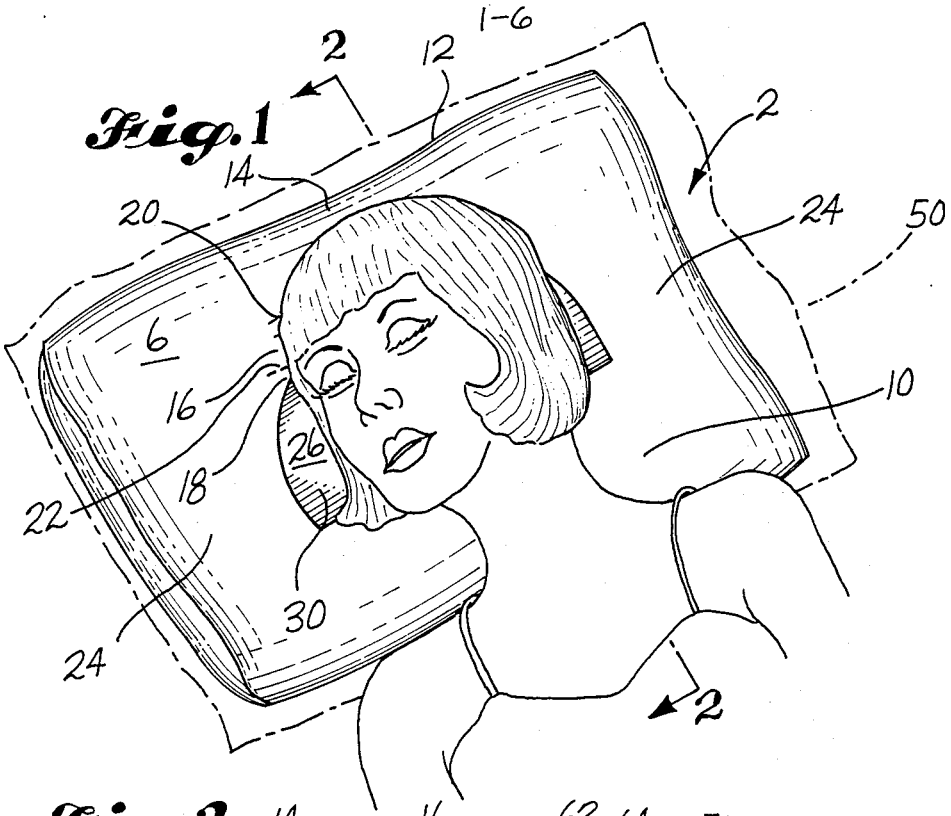
FIG. 1 is a pictorial view of the first preferred embodiment of the invention in use by a person lying in a supine position with the face turned slightly to the side, with the outline of the pillowcase shown in phantom.
Figure 3:
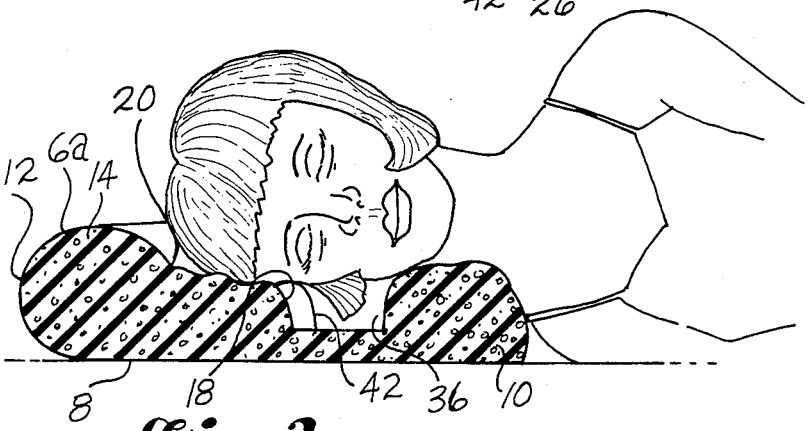
FIG. 3 is an elevational view of a person lying in a side position and using the pillow shown in FIGS. 1 and 2, with the pillow shown in section.

The drawings show three pillows 2, 2′, 2″ and two pillowcases 50, 80 that are constructed according to the invention and that also constitute the best modes of the invention currently known to the applicant. FIGS. 1 and 3 illustrate the pillow 2 in use by a sleeper in a supine position and a side position, respectively.

The pillow body 2, 2′, 2″ is generally rectangular and has a top surface 6 and a bottom surface 8. An oblong hollow 30 is formed in the body 2, 2′, 2″ and opens onto the top surface 6. The body 2, 2′, 2″ has a forward portion 10, 10″, a rear portion 12, 12′, 12″, and two opposite side portions 24. As used herein, the terms "forward" and "rear" refer to the portions nearer the foot of a bed and those nearer the head of a bed, respectively. The forward portion 10, 10″ provides support for the neck and chin of a user, and the rear portion 12, 12′, 12″ provides support for the top portion of the user's head. The forward portion 10, 10″ preferably has a maximum thickness that is no greater than the maximum thickness of the rear portion 12, 12′, 12″ to ensure proper relative positioning of the head and neck of a user. Referring to FIGS. 1, 4, 5, 8–11, 14 and 16, the side portions 24 stabilize the shape of the other portions of the pillow body 2, 2′, 2″ and are dimensioned to make the overall dimensions of the pillow body 2, 2′, 2″ substantially equal to standard pillow dimensions.

In the first two embodiments, the top surface *6a, 6a′* of the rear portion 12, 12′ has a contoured configuration to form a laterally central depression in the rear portion 12, 12′. This depression has the functions described above. In the first preferred embodiment shown in FIGS. 1–15, the depression is formed by a plurality of laterally extending rounded ridges separated by a plurality of laterally extending valleys. There are three ridges 14, 16, 18 and two valleys 20, 22 on the top surface *6a* of the rear portion 12 shown in FIGS. 1–5, but a different number of ridges and valleys could also be provided. Each valley 20, 22 has a length that is less than the length of any valley positioned forward thereof; i.e., as is best seen in FIG. 4, the more rearward valley 20 is shorter than the more forward valley 22. The relative length dimensions of the valleys 20, 22, along with a gentle forward sloping of the rear portion 12, encourage a user of the pillow to remain in or move toward a position in which the user's head is in an ideal position near the lateral center of the pillow 2. In the second preferred embodiment shown in FIGS. 8 and 9, the depression is formed by a plurality of generally forwardly extending valleys 70, 72 separated by a plurality of rounded ridges 74. A forwardly extending center valley 70 is flanked by two opposite side valleys 72 that extend rearwardly and laterally inwardly. The valleys 20, 22, 70, 72 may be formed by stitching the pillow body 2, 2' after it is formed, as part of a mold forming process of the body 2, 2', or by other suitable means.

The forward sloping of the rear portion 12 of the embodiment shown in FIGS. 1–5 is the net result of the relative dimensioning of the thicknesses of ridges 14, 16, 18 and valleys 20, 22. Each ridge is thicker than any ridge forward thereof, and each valley is thicker than any valley forward thereof. As can best be seen in FIG. 2, the more rearward valley 20 has a thickness greater than the forward valley 22, the rearwardmost ridge 14 is thicker than the middle ridge 16, and the middle ridge 16 is thicker than the forwardmost ridge 18. The maximum thickness of the rear portion 12 is equal to the maximum thickness of the rear ridge 14 and is no greater than the maximum thickness of the forward portion 10. As shown in FIGS. 1–5, the maximum thickness of the rear portion 12 is just slightly less than the maximum thickness of the forward portion 10.

Figure 2:
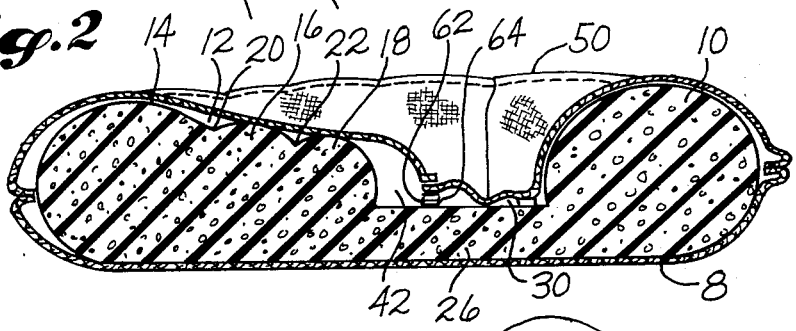
FIG. 2 is a sectional view taken along the line 2—2 in FIG. 1 with the user omitted and the pillowcase shown in solid lines.

The forward sloping of the rear portion 12 and the relatively greater thickness of the forward portion 10 ensure proper positioning of the head and neck of a user to avoid or alleviate backaches and neck pains. As can best be seen in FIG. 3, this proper positioning includes the positioning of the headrest surface below the neckrest surface. In addition, forward portion 10 preferably has a rounded cross section, as shown in FIGS. 2 and 3, to maximize the comfort of the user.

Figure 8:
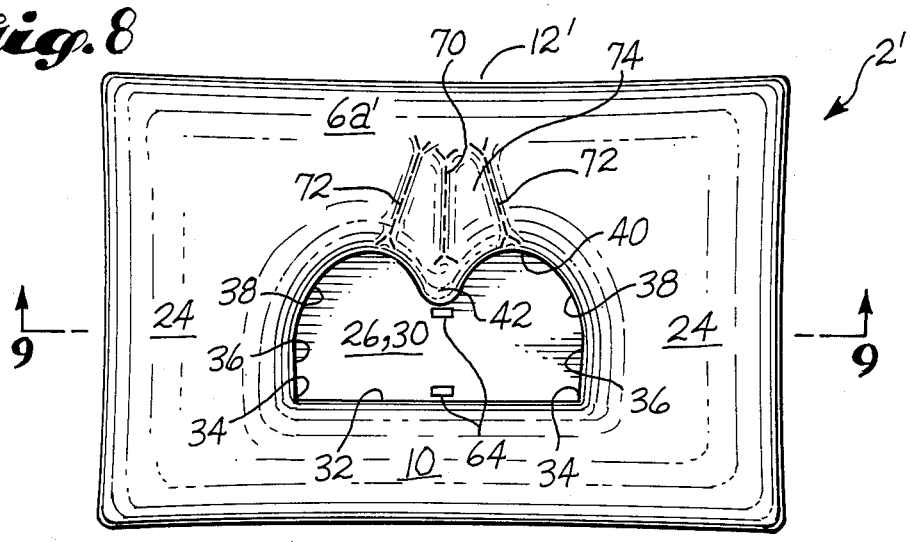
FIGS. 8 and 9 are like FIGS. 4 and 5 except that they show a second preferred embodiment of the pillow.
Figure 9:
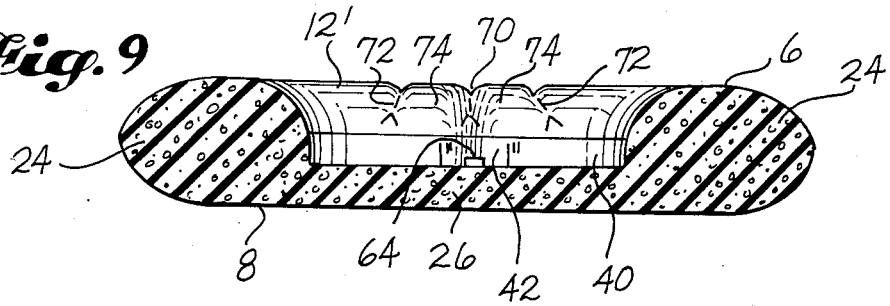

The preferred configuration of the hollow 30 is best seen in FIGS. 4 and 8. The hollow 30 has an essentially straight forward edge 32 and substantially straight opposite side edges 36 that meet the forward edge 32 at substantially square forward corners 34. Arcuate edge portions 38 connect the side edges 36 to the rear edge 40. The arcuate edge portions 38 help stabilize the shape of the hollow 30 and cooperate with the contoured configuration of the rear portion 12, 12' to guide the head of a user into a central position. The dimensions of the hollow 30, especially the length of the side edges 36, could be provided in a number of sizes, such as small, medium, and large, to fit different head sizes. However, the preferred configuration of the hollow 30 shown in FIGS. 2–5, 8, and 9 is designed to fit any normal head size. The rear edge 40 of the hollow 30 has a center portion that curves toward and then away from the forward edge 32 to form a forwardly extending projection 42. This projection 42 is an integral part of rear portion 12, 12' and functions as described above.

As shown in FIGS. 2, 3, 5 and 9, the pillow body 2, 2' preferably has a bottom portion 26 that extends between the forward portion 10 and the rear portion 12, 12'. This bottom portion 26 defines a bottom of the hollow 30 and forms a continuous bottom connecting the forward, rear, and side portions 10, 12, 12', 24. This increases the dimensional stability of the hollow 30 and the body 2, 2'.

The hollow 30, the forward portion 10, and the rear portion 12, 12' are dimensioned and positioned to support the head and neck of a user in a proper manner and to prevent the pillow 2, 2' from exerting pressure on a lower portion of the user's face. FIG. 1 illustrates the support that the pillow 2 provides to a user lying in a supine position. A top portion of the back of the user's head is supported by the rear portion 12, the back of the user's head below such top portion of the head is adjacent to the hollow 30, and the user's neck is supported by the forward portion 10. FIG. 3 illustrates the use of the pillow 2 in a side position. The user's neck and a top portion of the user's head are supported by the forward portion 10 and the rear portion 12 of the pillow body 2, respectively, as they were when the user was lying in a supine position. The forward portion 10 also supports the user's chin to maintain correct positioning of the head. The lower portion of the user's face below the temple and above the chin has moved into a position adjacent to the hollow 30, and this positioning of such lower portion of the face prevents the exertion of pressure on such lower portion by the pillow 2. The advantages of the support and protection against pressure illustrated in FIGS. 1 and 3 have been discussed above.

The third preferred embodiment of the pillow 2" is shown in FIGS. 10–16 and 18. In the finished form of this embodiment, shown in FIGS. 14–16 and 18, the center hollow 30 has the same preferred configuration shown in FIGS. 4 and 8. The forward portion 10" and the rear portion 12" of the pillow body 2" provide support for the user in the same manner illustrated in FIGS. 1 and 3 and described above.

The major difference between the third embodiment and the first two embodiments is the manner in which the rear portion 12" forms the laterally central depression which encourages the user to maintain the head in the proper position. In the third embodiment, a laterally central internal cavity 44 is formed in the rear portion 12". This cavity 44 reduces the density of the laterally central portion of the rear portion 12" relative to surrounding parts of the rear portion 12". The cavity 44 forms the desired central depression when pressure is applied to the rear portion 12", such as by a user's head resting on the rear portion 12". The forward portion 10" is preferably also formed with a laterally central internal cavity 46. This cavity 46 functions in a manner similar to the cavity 44 and reduces the density of the forward portion 10" at its lateral center. This forms a forward laterally central depression in the forward portion 10" when pressure is applied to the forward portion 10" to encourage a user to maintain the neck near the lateral center of the forward portion 10". The reduction of the densities of the central portions of the rear portion 12" and the forward portion 10" may also be accomplished by other means. For example, the densities of the central portions could be reduced during a molding process without forming appreciable cavities.

The bottom portion 26 of the first two embodiments is shown as being integrally formed with the forward, rear, and side portions 10, 12, 12', 24. In the third preferred embodiment, the bottom portion 26" is preferably formed separately from the forward, rear, and side portions 10", 12", 24. The separate forming of the bottom portion 26" facilitates the forming of the cavities 44, 46 and makes it possible to use a firmer material for the bottom portion 26".

Figure 10:
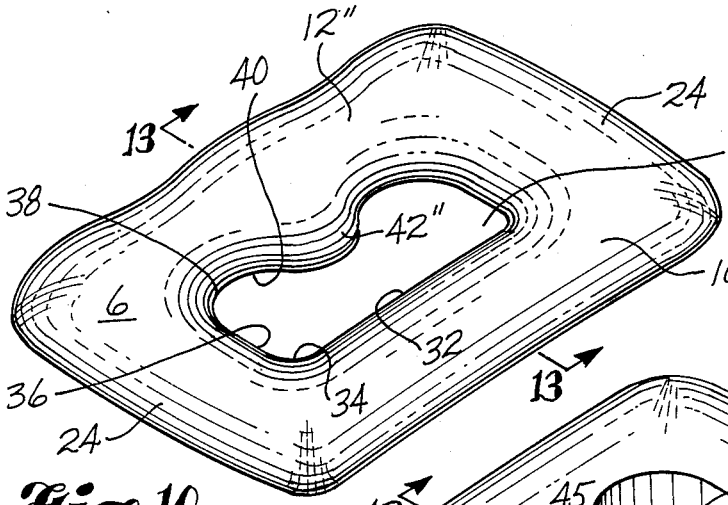
FIG. 10 is a pictorial view showing the third preferred embodiment of the pillow without the bottom portion.
Figure 11:
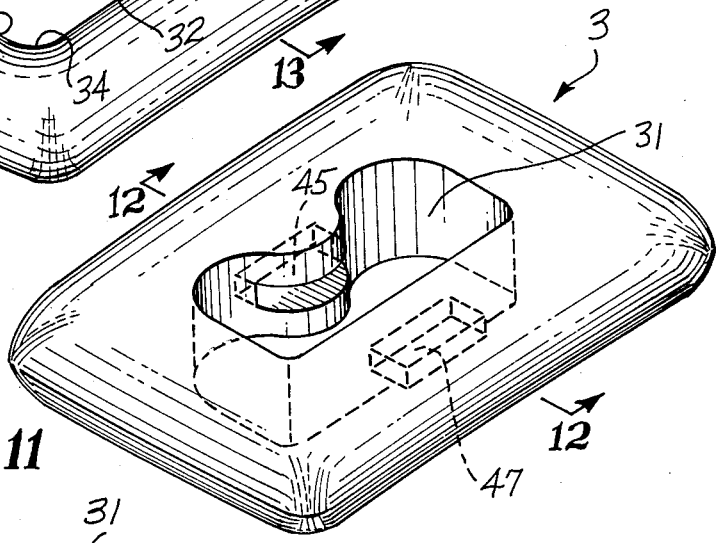
FIG. 11 is a pictorial view of a contoured block of foam after the center opening and the cavities have been cut to form the third preferred embodiment but before the cut edges are glued together.
Figure 12:
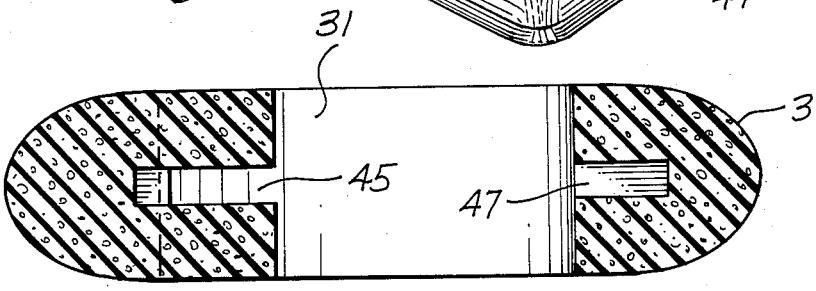
FIG. 12 is a sectional view taken along the line 12—12 in FIG. 11.
Figure 13:
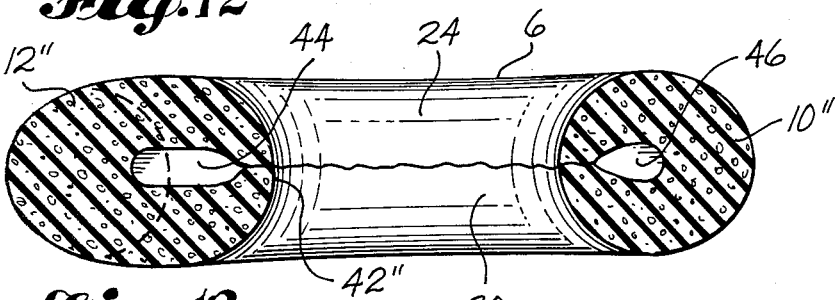
FIG. 13 is a sectional view taken along the line 13—13 in FIG. 10.
Figure 14:
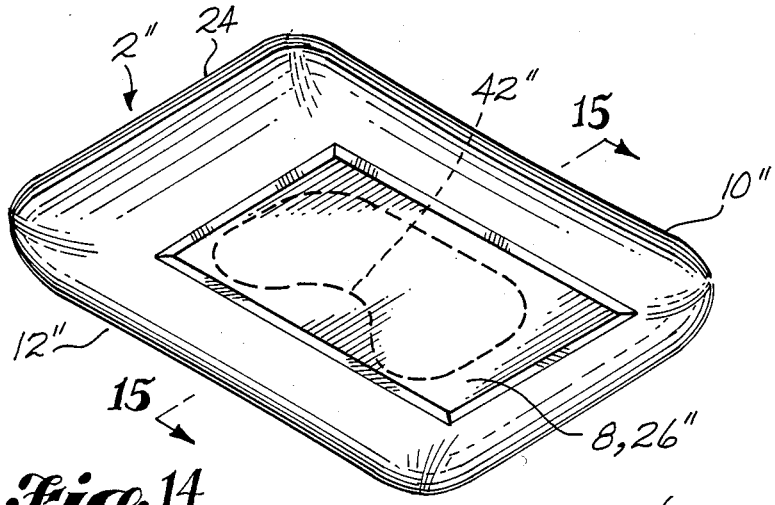
FIG. 14 is a pictorial view of the completed third preferred embodiment of the pillow looking toward the bottom of the pillow.
Figure 15:
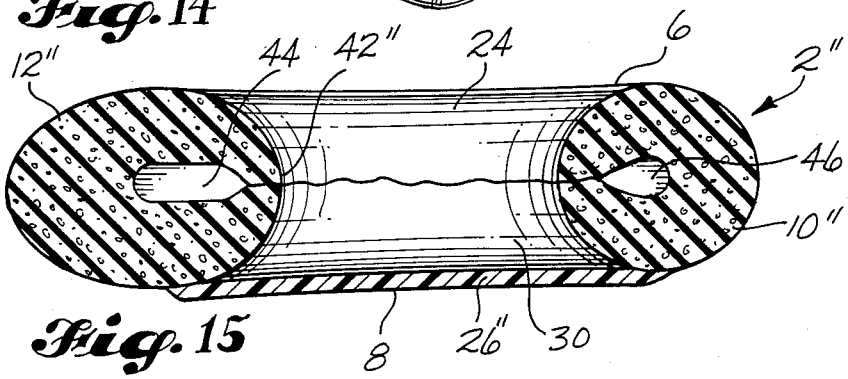
FIG. 15 is a sectional view taken along the line 15—15 in FIG. 14.

FIGS. 10–15 illustrate the stages of the preferred method of fabrication of the pillow 2". The fabrication begins with a block of foam shaped like an ordinary pillow. This foam block 3 is cut as shown in FIGS. 11 and 12. A central aperture 31 is cut to extend through the block 3 from the top surface to the bottom surface. Slots 45, 47 are cut to extend laterally into the sidewalls of the block 3 from the central aperture 31. Then, the cut sidewalls of the aperture 31 are folded in half, and the halves are glued together as shown in FIG. 13. This leaves a smooth structure with no external cut edges, as shown in FIGS. 10 and 13. Referring to FIG. 13, when the cut sidewalls are glued together, the slots 45, 47 form the cavities 44, 46 in the forward and rear portions 10", 12", and the central aperture 31 forms the hollow 30. As in the other embodiments, the forward projection 42" projects into the hollow 30. The cavity 44 extends into the forward projection 42". After the cut sidewalls have been glued as shown in FIG. 13, the bottom portion 26" is joined by suitable means to bottom surfaces of the forward, rear, and side portions 10", 12", 24, as shown in FIGS. 14 and 15. The pillow body 2" is then complete with the bottom surface of the bottom portion 26" forming a part of the bottom surface 8 of the body 2" and the top surface of the bottom portion 26" defining the bottom of the hollow 30.

The pillow body 2, 2', 2" may be made from a variety of materials that have sufficient firmness to provide proper support for the head and neck and to give the pillow body 2, 2', 2" dimensional stability. An example of a suitable material is a high quality latex foam rubber. This material gives the forward and rear portions 10, 10", 12, 12', 12" sufficient firmness to properly support the neck and head and the forward, rear, side, and bottom portions 10, 10", 12, 12', 12", 24, 26, 26" sufficient firmness to stabilize the shape of the pillow 2, 2', 2" to ensure its continued proper functioning. The bottom portion 26, 26" could also be made from a firmer material to further increase the stability of the pillow 2, 2', 2".

For purposes of hygiene and aesthetics, the pillow 2, 2', 2" is preferably provided with a pillowcase. In order to retain the benefits of the pillow 2, 2', 2", it is necessary that the pillowcase leave the hollow 30 in the pillow 2, 2', 2" substantially unobstructed to prevent the pillowcase from exerting pressure on the lower portion of the user's face. FIGS. 2, 6 and 7 illustrate a preferred embodiment of a pillowcase 50 designed for use with the pillow 2, 2'. Referring to FIGS. 6 and 7, the pillowcase 50 has a top layer 52 and a bottom layer 54 which are dimensioned to receive the body 2, 2' of the pillow therebetween. The top and bottom layers 52, 54 are stitched together along three peripheral edges to leave a side opening in the manner of conventional pillowcases.

The top layer 52 has a laterally extending opening 60 defined by a forward edge 56 and a rear edge 58. The opening 60 is aligned with the hollow 30 in the pillow body 2, 2'. Fastening means is provided for fastening the rear edge 58 and the forward edge 56 to the bottom portion 26 of the pillow body 2, 2', to cover the rear portion 12, 12' and forward portion 10 of the pillow 2, 2' while leaving the hollow 30 substantially unobstructed. The preferred embodiment of the fastening means, shown in FIGS. 2, 6, and 7, comprises four strips of material 62, 64 having interlockable filaments. An example of such a material is the material sold under the trademark Velcro. One strip 62 is attached to each of the forward and rear edges 56, 58, and two complementary strips are attached to the bottom portion 26 inside the hollow 30. FIGS. 4 and 8 show the positioning of the strps 64 inside the hollow 30.

Figure 16:
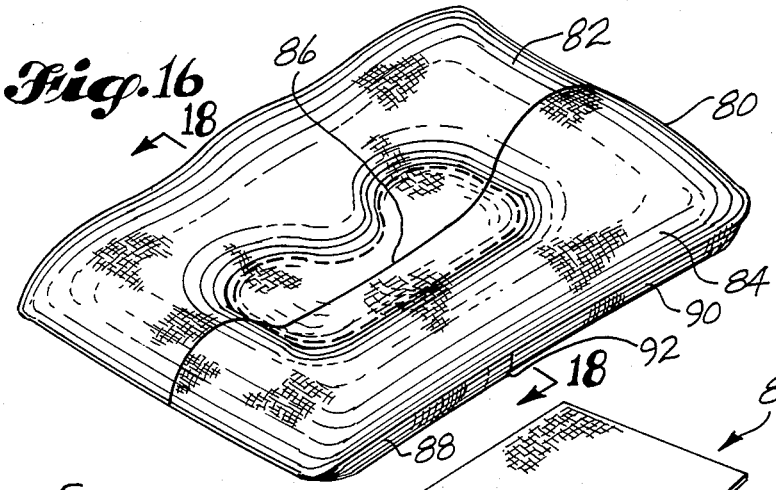
FIG. 16 is a pictorial view of the pillow shown in FIGS. 14 and 15 and a second preferred embodiment of the pillowcase.
Figure 17:
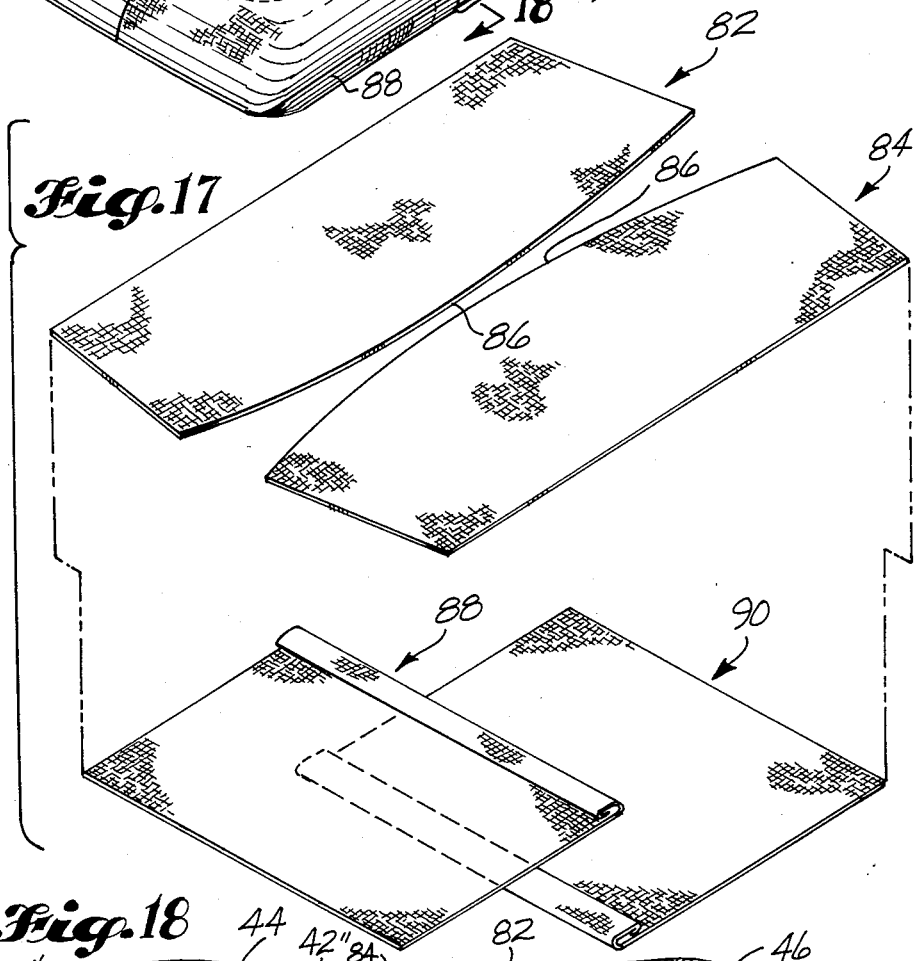
FIG. 17 is an exploded pictorial view of the pillowcase shown in FIG. 16.
Figure 18:
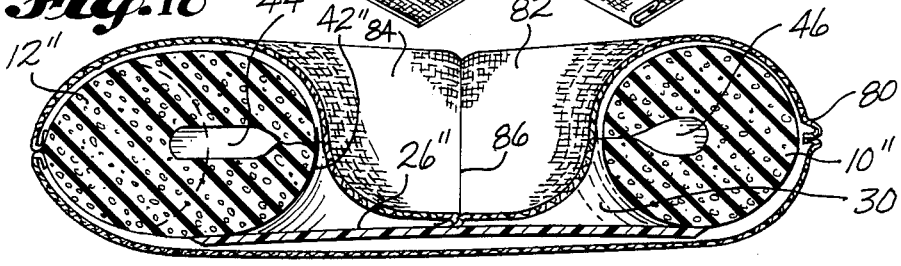
FIG. 18 is a sectional view taken along the line 18—18 in FIG. 16.

FIGS. 16–18 show another preferred embodiment of a pillowcase 80. The pillowcase 80 has a top layer 82, 84 and a bottom layer 88, 90 dimensioned to receive the body 2" of the pillow therebetween. Each of the layers 82, 84, 88, 90 is formed from two pieces. The two pieces 82, 84 of the top layer have outwardly curved inner edges 86, best seen in FIG. 17, that are joined together, such as by sewing. The inner edges 86 extend laterally and are aligned with the hollow 30 in the pillow body 2", as shown in FIGS. 16 and 18. The other three edges of each piece 82, 84 are joined to the bottom layer 88, 90. The pieces 88, 90 of the bottom layer have inner edges that extend between the rear and forward edges of the pillowcase 80 and are hemmed, as shown in FIG. 17, to form finished edges. In the completed pillowcase 80 shown in FIGS. 16 and 18, these hemmed edges overlap each other and define an opening 92 for receiving the pillow body 2". The opening could also be provided at one end of the pillowcase 80, with the bottom layer 88, 90 being one piece. In either case, the opening could be closed with a zipper or other suitable means. The curved configuration of the inner edges 86 of the top layer pieces 82, 84 cause the top layer 82, 84 of the finished pillowcase 80 to drape down into the hollow 30 of the pillow body 2", as shown in FIGS. 16 and 18. This leaves the hollow 30 substantially unobstructed and prevents the pillowcase 80 from exerting pressure on the lower portion of the user's face adjacent to the hollow 30.

Although the first embodiment of the pillowcase 50 is shown and described in connection with the first two embodiments of the pillow 2, 2' and the second embodiment of the pillowcase 80 is shown and described in connection with the third embodiment of the pillow 2", it is of course to be understood that either pillowcase 50, 80 can be used with any of the preferred embodiments of the pillow or any other embodiment of the pillow within the scope of the claims.

Although the preferred embodiments of the invention have been described herein, it is of course to be understood that various changes, modifications, and omissions in form and detail may be made without departing from the spirit and scope of the invention as defined by the following claims.

What is claimed is:

1. A pillow comprising a generally rectangular body having a top surface, a bottom surface, an oblong hollow formed in the body and opening onto the top surface, a forward portion, and a rear portion; said hollow, said forward portion, and said rear portion being dimensioned and positioned so that, when a user is lying in a first supine position, a top portion of the back of the user's head is supported by said rear portion, the back of the user's head below said top portion is adjacent to the hollow, and the user's neck is supported by said forward portion, and when the user turns from said supine position to a second side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face; and said rear portion having a laterally central portion with means for forming a laterally central depression in said rear portion when a user is in said supine position or said side position and when a user turns from one of said positions to the other, to provide a resting place for the top of a user's head at the lateral center of the pillow and to encourage the user to maintain the head near said lateral center.

2. A pillow as described in claim 1, in which the hollow has an essentially straight forward edge, opposite side edges that meet said straight forward edge at substantially square forward corners, and arcuate edge portions connecting said side edges to a rear edge.

3. A pillow as described in claim 1, in which the body further comprises a side portion on each side of the hollow, said side portions being dimensioned to give the pillow an overall standard size and having sufficient firmness to stabilize the shape of the body.

4. A pillow as described in claim 1, in which said rear portion has a top surface that is contoured to form said central depression.

5. A pillow as described in claim 4, in which said top surface of said rear portion has a plurality of rounded ridges separated by a plurality of valleys to form said central depression.

6. In combination:

a pillow comprising a generally rectangular body having a top surface, a bottom surface, an oblong hollow formed in the body and opening onto the top surface, a forward portion, and a rear portion; said rear portion having a laterally central portion that forms a laterally central depression in said rear portion when the pillow is in use, to provide a resting place for the top of a user's head at the lateral center of the pillow and to encourage the user to maintain the head near said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face; and said body including a bottom portion extending between said forward and rear portions and defining a bottom of the hollow, to increase the dimensional stability of the hollow and said forward and rear portions;

a pillowcase having a top layer and a bottom layer dimensioned to receive the body of the pillow therebetween, said top layer having a laterally extending opening defined by a rear edge and a forward edge, and said opening being aligned with the hollow; and fastening means, carried by said rear edge and said forward edge of the top layer of the pillowcase and by said bottom portion of the body of the pillow, for fastening said rear edge and said forward edge to said bottom portion, to cover said rear portion and said forward portion of the pillow while leaving the hollow substantially unobstructed to prevent the pillowcase from exerting pressure on said lower portion of the user's face.

7. In combination:

a pillow comprising a generally rectangular body having a top surface, a bottom surface, an oblong hollow formed in the body and opening onto the top surface, a forward portion, and a rear portion; said rear portion having a laterally central portion that forms a laterally central depression in said rear portion when the pillow is in use, to provide a resting place for the top of a user's head at the lateral center of the pillow and to encourage the user to maintain the head near said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face; and a pillowcase having a top layer and a bottom layer dimensioned to receive the body of the pillow therebetween, and an opening for receiving the pillow; said top layer being formed from two pieces each of which has a laterally extending inner edge aligned with the hollow, said inner edges being joined together and being curved outwardly to cause said top layer to drape down into the hollow to leave the hollow substantially unobstructed and prevent the pillowcase from exerting pressure on said lower portion of the user's face.

8. A pillow comprising a generally rectangular body having a top surface, a bottom surface, an oblong hollow formed in the body and opening onto the top surface, a forward portion, and a rear portion; said rear portion having a laterally central portion that forms a laterally central depression in said rear portion when the pillow is in use, to provide a resting place for the top of a user's head at the lateral center of the pillow and to encourage the user to maintain the head near said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face;

in which said rear portion has a top surface that is contoured to form said central depression; said top surface of said rear portion has a plurality of rounded ridges separated by a plurality of valleys to form said central depression; and said ridges and said valleys extend laterally along the top surface of said rear portion, each said valley having a length that is less than the length of any said valley positioned forward thereof, and said rear portion decreasing in thickness in a forward direction from ridge to ridge and from valley to valley.

9. A pillow comprising a generally rectangular body having a top surface, a bottom surface, an oblong hollow formed in the body and opening onto the top surface, a forward portion, and a rear portion; said rear portion having a laterally central portion that forms a laterally central depression in said rear portion when the pillow is in use, to provide a resting place for the top of a user's head at the lateral center of the pillow and to encourage the user to maintain the head near said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face;

in which said rear portion has a top surface that is contoured to form said central depression; said top surface of said rear portion has a plurality of rounded ridges separated by a plurality of valleys to form said central depression; and said valleys include a forwardly extending center valley and opposite side valleys that extend rearwardly and laterally inwardly.

10. A pillow comprising a generally rectangular body having a top surface, a bottom surface, an oblong hollow formed in the body and opening onto the top surface, a forward portion, and a rear portion; said rear portion having a laterally central portion that forms a laterally central depression in said rear portion when the pillow is in use, to provide a resting place for the top of a user's head at the lateral center of the pillow and to encourage the user to maintain the head near said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face;

in which said central portion of said rear portion has a reduced density relative to surrounding parts of said rear portion to form said central depression when pressure is applied to said rear portion.

11. A pillow as described in claim 10, in which said rear portion is formed with a laterally central internal cavity to reduce the density of said central portion of said rear portion and form said central depression when pressure is applied to said rear portion.

12. A pillow as described in claim 11, in which said forward portion is formed with a laterally central internal cavity to reduce the density of said forward portion at its lateral center and form a forward laterally central depression when pressure is applied to said forward portion to encourage a user to maintain the neck near the lateral center of said forward portion.

13. A pillow comprising a generally rectangular body having a top surface, a bottom surface, an oblong hollow formed in the body and opening onto the top surface, a forward portion, and a rear portion; said hollow having a forward edge, and a rear edge with a center portion that projects forwardly toward said forward edge; and said hollow, said forward portion, and said rear portion being shaped and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face.

14. A pillow as described in claim 13, in which said rear portion has a laterally central portion that forms a laterally central depression in said rear portion when the pillow is in use, to provide a resting place for the top of a user's head at the lateral center of the pillow and to encourage and user to maintain the head near said lateral center.

15. A pillow as described in claim 14, in which the hollow has an essentially straight forward edge, opposite side edges that meet said straight forward edge at substantially square forward corners, and arcuate edge portions connecting said side edges to a rear edge.

16. A pillow as described in claim 13, in which the body further comprises a side portion on each side of the hollow, said side portions being dimensioned to give the pillow an overall standard size and having sufficient firmness to stabilize the shape of the body.

17. In combination:

the pillow of claim 13, and a pillowcase having a top layer and a bottom layer dimensioned to receive the body of the pillow therebetween, and an opening for receiving the pillow; said top layer being formed from two pieces each of which has a laterally extending inner edge aligned with the hollow, said inner edges being joined together and being curved outwardly to cause said top layer to drape down into the hollow to leave the hollow substantially unobstructed and prevent the pillowcase from exerting pressure on said lower portion of the user's face.

18. A pillow as described in claim 14, in which said rear portion has a top surface that has a plurality of rounded ridges separated by a plurality of valleys to form said central depression.

19. A hollow as described in claim 14, in which said central portion of said rear portion has a reduced density relative to surrounding parts of said rear portion to form said central depression when pressure is applied to said rear portion.

20. A pillow as described in claim 19, in which said rear portion is formed with a laterally central internal cavity to reduce the density of said central portion of said rear portion and form said central depression when pressure is applied to said rear portion.

21. A pillow as described in claim 20, in which said forward portion is formed with a laterally central internal cavity to reduce the density of said forward portion at its lateral center and form a forward laterally central depression when pressure is applied to said forward portion to encourage a user to maintain the neck near the lateral center of said forward portion.

22. A pillow comprising a generally rectangular body having a top surface, a bottom surface, an oblong hollow formed in the body and opening onto the top surface, a forward portion having a first maximum thickness, and a rear portion having a top surface and a second maximum thickness that is no greater than said first maximum thickness; said top surface of said rear portion being contoured to form a laterally central depression in said rear portion, to provide a resting place for the top of a user's head at the lateral center of the pillow and to encourage the user to maintain the head rear said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face; and said hollow having a forward edge, and a rear edge with a center portion that projects forwardly toward said forward edge.

23. A pillow as described in claim 22, in which the forward edge of the hollow is essentially straight; and the hollow has opposite side edges that meet the straight forward edge at substantially square forward corners, and arcuate edge portions connecting said side edges to the rear edge.

24. In combination:

a pillow comprising a generally rectangular body having a top surface, a bottom surface, an oblong hollow formed in the body and opening onto the top surface, a forward portion having a first maximum thickness, and a rear portion having a top surface and a second maximum thickness that is no greater than said first maximum thickness; said top surface of said rear portion being contoured to form a laterally central depression in said rear portion, to provide a resting place for the top of a user's head at the lateral center of the pillow and to encourage the user to maintain the head near and said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face; and said body including a bottom portion extending between said forward and rear portions and defining a bottom of the hollow, to increase the dimensional stability of the hollow and said forward and rear portions;

a pillowcase having a top layer and a bottom layer dimensioned to receive the body of the pillow therebetween, said top layer having a laterally extending opening defined by a rear edge and a forward edge, and said opening being aligned with the hollow; and fastening means, carried by said rear edge and said forward edge of the top layer of the pillowcase and by said bottom portion of the body of the pillow, for fastening said rear edge and said forward edge to said bottom portion, to cover said rear portion and said forward portion of the pillow while leaving the hollow substantially unobstructed to prevent the pillowcase from exerting pressure on said lower portion of the user's face.

25. A pillow as described in claim 22, in which said central depression is formed by a plurality of laterally extending rounded ridges separated by a plurality of laterally extending valleys, each said valley having a length that is less than the length of any said valley positioned forward thereof, and said rear portion decreasing in thickness in a forward direction from ridge to ridge and from valley to valley.

26. A pillow as described in claim 25, in which the forward edge of the hollow is essentially straight; and the hollow has opposite side edges that meet the straight forward edge at substantially square forward corners, and arcuate edge portions connecting said side edges to the rear edge.

27. A pillow comprising a generally rectangular body having a top surface, a bottom surface, an oblong hollow formed in the body and opening onto the top surface, a forward portion having a first maximum thickness, and a rear portion having a top surface and a second maximum thickness that is no greater than said first maximum thickness; said top surface of said rear portion being contoured to form a laterally central depression in said rear portion, to provide a resting place for the top of a user's head at the lateral center of the pillow and to encourage the user to maintain the head near said lateral center; said hollow, said forward portion, and said rear portion being dimensioned and positioned so that, when a user is lying in a supine position, a top portion of the back of the user's head is supported by said rear portion, the back of the user's head below said top portion is adjacent to the hollow, and the user's neck is supported by said forward portion, and when the user turns from a supine position to a side position, the user's neck and a top portion of the user's head continue to be supported by said forward portion and said rear portion, respectively, and a lower portion of the user's face below the user's temple moves into a position adjacent to the hollow to prevent the pillow from exerting pressure on said lower portion of the user's face; and said central depression being formed by a plurality of valleys separated by a plurality of rounded ridges, said valleys including a forwardly extending center valley and opposite side valleys that extend rearwardly and laterally inwardly.

28. A pillow as described in claim 27, in which the hollow has an essentially straight forward edge, opposite side edges that meet said straight forward edge at substantially square forward corners, and arcuate edge portions connecting said side edges to a rear edge.

29. A pillow as described in claim 27, in which the hollow has a forward edge, and a rear edge with a center portion that projects forwardly toward said forward edge.

30. A pillow as described in claim 28, in which said rear edge of the hollow includes a center portion that projects forwardly toward said forward edge.

31. A pillow as described in claim 27, in which the body includes a bottom portion extending between said forward and rear portions and defining a bottom of the hollow, to increase the dimensional stability of the hollow and said forward and rear portions.

* * * * *